US005450868A

United States Patent [19]

Young, Jr.

[11] Patent Number: 5,450,868

[45] Date of Patent: Sep. 19, 1995

[54] DISHWASHER PUMP AND FILTRATION SYSTEM

[75] Inventor: Raymond A. Young, Jr., Kinston, N.C.

[73] Assignee: White Consolidated Industries, Inc., Cleveland, Ohio

[21] Appl. No.: 282,984

[22] Filed: Jul. 29, 1994

Related U.S. Application Data

[62] Division of Ser. No. 146,596, Nov. 1, 1993, Pat. No. 5,377,707.

[51] Int. Cl.[6] ..... A47L 15/23; A47L 15/42

[52] U.S. Cl. ..... 134/111; 134/115 G

[58] Field of Search ..... 134/104.1, 104.4, 111, 134/115 G, 148, 174, 176, 179, 182; 241/46.012, 69; 210/167, 411; 415/121.1, 121.2

[56] References Cited

U.S. PATENT DOCUMENTS

| | | | |
|---|---|---|---|
| 3,310,243 | 3/1967 | Duncan et al. | 241/46.012 X |
| 4,038,103 | 7/1977 | Grunewald | 134/111 X |
| 4,150,680 | 4/1979 | Johnson et al. | 134/104 |
| 4,168,715 | 9/1979 | Spiegel et al. | 134/111 X |
| 4,243,431 | 1/1981 | Dingler et al. | 134/104.1 |
| 4,319,598 | 3/1982 | Dingler et al. | 134/104.4 X |
| 4,319,599 | 3/1982 | Dingler et al. | 134/104.4 |
| 4,346,723 | 8/1982 | Geiger | 134/104.4 |
| 4,392,891 | 7/1983 | Meyers | 134/111 X |
| 4,448,359 | 5/1984 | Meyers | 134/115 G X |
| 4,468,333 | 8/1984 | Geiger | 210/798 |
| 4,559,959 | 12/1985 | Meyers | 134/56 D |
| 4,612,947 | 9/1986 | Duncan | 134/104.1 |
| 4,673,441 | 6/1987 | Mayers | 134/104.4 X |
| 4,730,630 | 3/1988 | Ranft | 134/111 |
| 4,795,102 | 1/1989 | Jordan et al. | 134/115 G X |
| 5,165,433 | 11/1992 | Meyers | 134/104.4 X |
| 5,165,435 | 11/1992 | Thies et al. | 210/411 X |
| 5,282,579 | 2/1994 | Poser et al. | 241/69 |

*Primary Examiner*—Philip R. Coe

*Attorney, Agent, or Firm*—Pearne, Gordon, McCoy & Granger

[57] ABSTRACT

A reversibly operated dual impeller pump which simultaneously pumps and filters wash liquid. The pump includes upper and lower assemblies. The upper assembly defines a recirculation impeller chamber and a filter chamber which are separated by a cylindrical wall. A recirculation impeller housed within the recirculation impeller chamber pumps wash liquid, a majority of the pumped wash liquid being directed toward one or more wash rotatably mounted arms while a portion of the pumped wash liquid is supplied to the filtration chamber via a hole in the cylindrical wall. A novel vane structure is provided to direct the pumped wash liquid from the recirculation impeller to the wash arm. The lower assembly includes a lower pump housing, a separator plate, and a macerator assembly. The macerator assembly includes a vertical cylindrical wall which spaces the macerator blade from a bottom of the lower pump housing to prevent damaging contact between heavy or settled material and the blade. The macerator assembly also includes a drain impeller which, when the pump is operated in a recirculation mode, pumps wash liquid to the filtration chamber and, when the pump is operated in the drain mode, pumps wash liquid and soil from the sump and filtration chamber to drain.

19 Claims, 10 Drawing Sheets

DISHWASHER PUMP AND FILTRATION SYSTEM

This is a division of application Ser. No. 08/146,596, filed Nov. 1, 1993, now Pat. No. 5,377,707.

BACKGROUND OF THE INVENTION

1. Field of the Invention

The present invention pertains to dishwasher pumps and, more particularly, to a dishwasher pump and wash liquid filtration system.

2. Description of the Prior Art

As dishwashing machines have developed, it has become desirable to combine and coordinate wash water pumping and filtration operations. Filtration devices are typically integrally provided in the pump housing, or provided in spaced relation to the housing and fluidly connected thereto.

U.S. Pat. Nos. 4,319,598 and 4,319,599, which issued to Dingler et al. on Mar. 16, 1982, are exemplary of reversible, dual impeller pumps which include a soil separation or collection circuit. In the wash mode, the drain impeller is inoperative and the wash impeller takes wash liquid from the dishwasher sump, pumping a majority of the liquid back into the dishwasher tub through the wash arms. A centrifugally sampled portion of the wash liquid is diverted via an annular guide chamber and a small opening into a sealed accumulator chamber in which heavy soil separates or settles by gravity. A stand pipe extending from the bottom of the accumulator chamber permits surface liquid within the accumulator to return to the pump inlet, thereby recirculating cleansed liquid within the dishwasher. When the motor is reversed, the pump is operated in the drain or pump-out mode. The wash impeller is generally inoperable and the drain impeller pumps wash liquid from the sump to drain.

Another reversibly-operated dual impeller pump is disclosed in U.S. Pat. No. 4,612,947, which issued to Duncan on Sep. 23, 1986. In the '947 patent, during wash mode, an upper impeller supplies wash liquid to the lower or main wash arm and a lower impeller supplies wash liquid to auxiliary spray arms and to a separation or settling chamber. A majority of the water pumped by the lower impeller is directed toward the auxiliary wash arms, with a relatively smaller portion going to the settling chamber. Wash liquid, less the settled soil, exits the settling chamber and returns to the dishwasher cavity via a hole in a separation chamber top. In a second embodiment of the pump, the separation chamber top does not provide a hole, and the wash liquid is instead re-introduced into the lower impeller chamber and mixed with other liquid and thereafter distributed to the auxiliary spray arms or the settling chamber. When operated in the drain or pump-out mode the upper impeller is generally inoperable and the lower impeller pumps Wash liquid from the sump to drain. The Dingler and Duncan patents described above rely solely upon settling to filter or remove solid particles from the wash liquid.

U.S. Pat. No. 4,392,891 which issued to Meyers on Jul. 12, 1983, discloses another reversible, dual impeller pump having a soil collection circuit. However, unlike the Duncan and Dingler pumps disclosed hereinbefore, in the Meyers' pump the soil collection circuit is completely independent of the primary spray means. During wash mode, the upper impeller supplies wash liquid to the wash arms while the lower impeller supplies wash liquid to the soil collection circuit. The soil collector includes a mesh filter for filtering food soil from fluid passing therethrough and holds or retains the soil for discharge during draining of the machine. For references which show related pump and filtration schemes see U.S. Pat. Nos. 4,448,359; 4,559,959; and 4,673,441 which issued to Meyers on May 15, 1984; Dec. 24, 1985; and Jun. 16, 1987, respectively.

U.S. Pat. No. 5,165,433, which issued to Meyers on Nov. 24, 1992, discloses another combination pump and filter. The '433 patent is directed toward a dual impeller centrifugal pump wherein a portion of the water pumped by an upper impeller is sampled, directed toward an intermediate guide chamber and thereafter introduced into a soil collecting chamber via a hole. Heavy soil settles in the collecting chamber, while floating soil is filtered by a mesh filter screen. Cleansed liquid is re-introduced into the dishwasher sump and thereafter re-pumped by the upper impeller. Although there are two impellers in the '433 patent, the lower impeller is generally inoperable during the wash cycle and does not supply liquid to either the wash arm or the collecting chamber. Upon study of the references, it will be apparent that the pump described in the '433 patent is a combination of the pumps disclosed in the above-described U.S. Pat. Nos. 4,392,891 and 4,319,599.

U.S. Pat. Nos. 4,346,723 and 4,468,333, which issued to Geiger on Aug. 31, 1982 and Aug. 28, 1984, respectively, disclose yet another dual impeller, reversibly operated pump. The pumps disclosed in the Geiger patents have a soil collector circuit which is supplied with wash liquid from the drain impeller. The soil collector circuit includes a cylindrically-shaped mesh filter which is adapted and arranged to remove soil from wash liquid passing therethrough during a wash or recirculation mode. Wash liquid reverses direction when the pump is operated in a drain mode, allowing the filtered soil to be conveyed therewith to drain.

SUMMARY OF THE INVENTION

The present invention is directed toward a dual impeller, reversible pump wherein a portion of the wash liquid flowing through a filtration chamber is provided by each of the impellers. The present invention is also directed toward a novel flow path for wash liquid pumped by an upper impeller wherein the path that the wash liquid takes between the upper impeller and a wash arm helps to increase the volume of wash liquid pumped by the upper impeller. The present invention is also directed toward a combination pump and filter wherein both gravity and screening filtration is employed to cleanse wash liquid. The present invention is further directed toward a lower or drain impeller chamber structure which includes a trap to prevent dense or non-floating soil or food particles from reaching a macerator blade and thereby protects the macerator blade from damaging contact with such dense or large objects. The present invention is also directed toward a shroud that lies between the macerator blade and a drain impeller which helps regulate fluid flow through the macerator and directs the flow to an outer portion of the lower impeller vanes.

In accordance with the present invention the pump includes an upper or recirculation impeller and a lower or drain impeller. The recirculation impeller is located in a recirculation impeller chamber which is relatively above the drain impeller. During wash or recirculation mode the recirculation impeller chamber is primarily operable to supply wash liquid to wash arms within the dishwasher cavity and secondarily operable to supply wash liquid to a filtration and settling chamber radially spaced from the recirculation impeller chamber. During the wash or recirculation mode the drain impeller only provides wash liquid to the filtration and settling chamber. During the drain mode the recirculation impeller is generally inoperable and the drain impeller pumps wash liquid and filtered soil to drain.

In further accordance with the present invention, a three-piece construction is provided for an upper assembly of the pump and defines the filtration and recirculation impeller chambers. A first piece or top member of the upper assembly includes a series of fine mesh filtration screens, a downwardly extending cylindrical dividing wall, a series of curved directional vanes, and a bowl-shaped member. The bowl-shaped member has an open bottom, a series of slotted openings in its cylindrical side wall, and a series of downwardly extending projections on the annular bottom surface thereof. The second piece or bottom member of the upper assembly is generally concave, having an opening in the bottom thereof and providing an upstanding cylindrical dividing wall and a series of curved, upwardly-extending fluid directing vanes. A third piece or cap member is removably mounted to the top member and provides a series of guide vanes which direct wash liquid to a wash arm rotatably mounted to the cap member.

During assembly, the dividing walls provided by the top and bottom members mate to define a continuous cylindrical dividing wall which separates the recirculation impeller chamber from the filtration and separation chamber. Also during assembly, the vanes provided by the bottom member mate with the projections provided by the bowl-shaped member to provide continuous vanes which extend between the top and bottom members.

In further accordance with the present invention, a recirculation impeller chamber is defined by the dividing wall, the top and bottom members, and the cap member. A filtration chamber is defined by the top and bottom members and the dividing wall. A small opening is provided in the dividing wall which allows a portion of wash liquid pumped by the recirculation impeller to flow into the filtration chamber.

In further accordance with the present invention a unique flow pattern is established within the upper assembly which allows a high volume of wash liquid to be supplied to the rotary wash arm. The flow pattern begins at the rotary vortex-type recirculation impeller and, under the influence of the fluid-directing vanes, wash liquid flows radially outwardly into a circular flow path provided by the recirculation impeller chamber adjacent the dividing wall. A portion of the circularly-flowing wash liquid is optionally directed to an auxiliary wash arm, while the remainder engages the arcuate directional vanes and is thereby forced to flow radially inwardly. The inwardly-flowing wash liquid is directed by a series of guide vanes toward a distribution channel and then upwardly into the wash arm.

According to the present invention a lower assembly is located in the sump includes a macerator assembly, a separator plate, and a lower pump housing. The macerator assembly includes a main body, a shroud, a perforated grate, a macerator blade, and a drain impeller. The main body defines a central circular opening which is surrounded by an upstanding cylindrical wall. The cylindrical wall encircles the shroud, grate, and macerator blade, an cooperates with the housing member to define a trap which receives and retains dense or non-floating solids and thereby prevents such solids from engaging and damaging the macerator blade.

In further accordance with the present invention the shroud underlies the macerator blade and grate and cooperates with the main body to define a restricted flow path toward the drain impeller. The restricted flow path insures that solids within the wash water flowing past the macerator blades are contacted or operated upon by the macerator blade.

The drain impeller supplies wash liquid to the filtration chamber when the pump is operated in a recirculation mode. The drain impeller-supplied wash liquid combines with wash liquid from the recirculation impeller in the filtration chamber and flows through the mesh screens provided at the top of the upper assembly. The more dense dirt or food particles settle out of the wash liquid and are retained at the bottom of the filtration chamber while the floating food particles are filtered or strained by the mesh filters. The filtered wash liquid is returned to the sump while the filtered soil or food particles are back-flushed from the mesh filters by a rinsing spray of wash liquid supplied by the wash arms, and are held suspended within the filtration chamber.

When the motor is reversed to place the pump in the drain mode, the wash impeller becomes substantially inoperative, but the drain impeller, being bi-directional, pumps at about the same rate in reverse. This results in the wash liquid being pumped directly to the drain outlet. The input to the drain impeller in this mode is partially from the tub sump as in the wash mode and partially from the filtration chamber until all of the collected particles and the wash liquid are completely removed.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
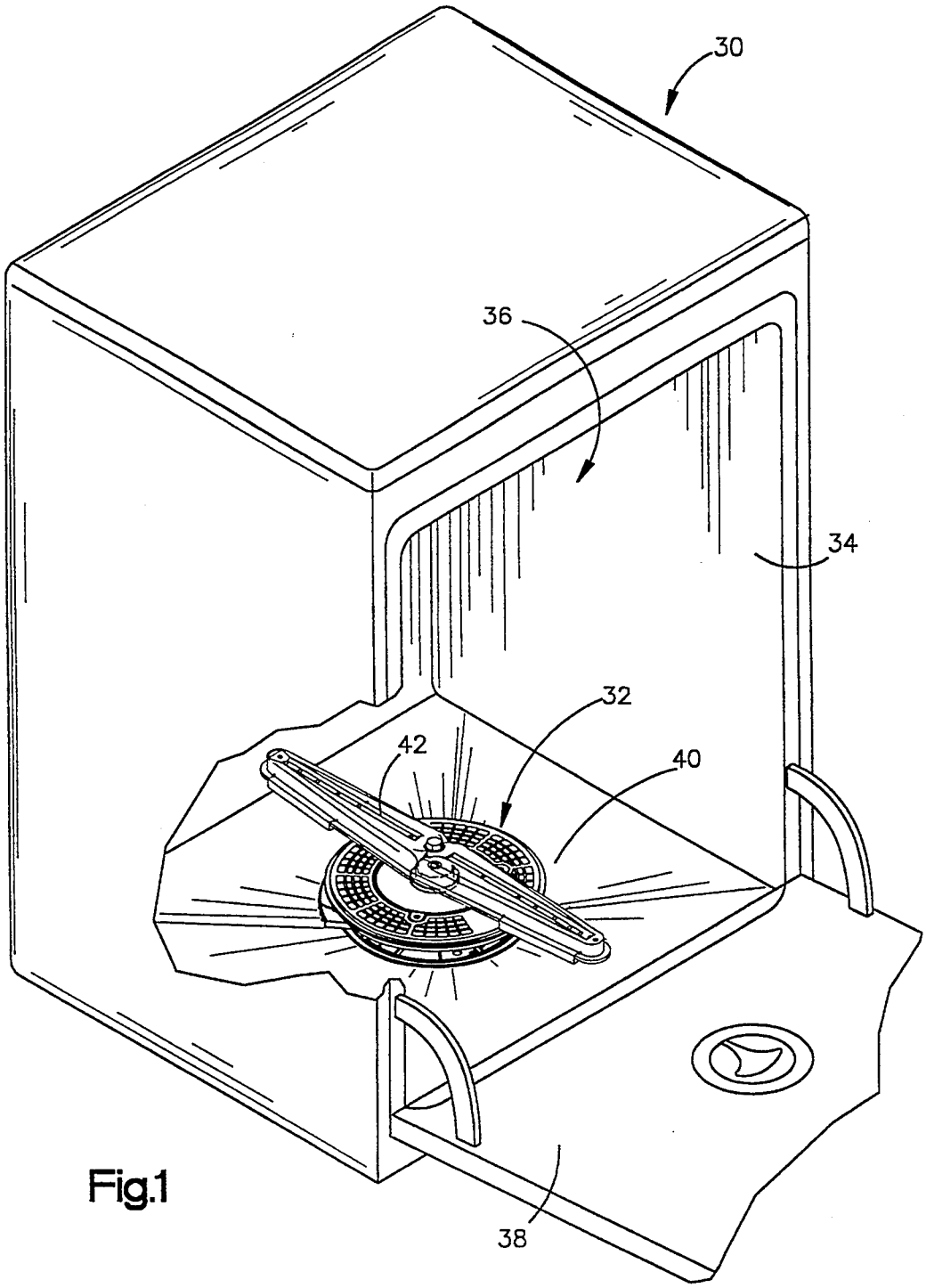
FIG. 1 is a perspective view of a dishwashing machine, with a door in an open position and tub partially broken away for clarity.

With reference to the drawing figures and, in particular FIG. 1, a dishwashing machine 30 incorporating the wash liquid pump 32 of the present invention is shown. As is conventional in the dishwashing machine art, the illustrated dishwashing machine 30 includes a tub 34 which defines a cavity 36 for receipt of racks (not shown) upon which items to be washed are placed. The tub 34 has an open front that is closed by a door 38 hinged for pivotal movement about its bottom edge. A bottom of the tub defines a sump 40 which retains a quantity of wash liquid during a wash or recirculation mode and from which collected wash liquid is pumped during a drain mode.

The pump 32 extends upwardly through an opening in the bottom of the tub 34 and into the sump 40 defined thereby. A rotatably mounted wash arm 42 is secured to a top of the pump 32, as will be discussed hereafter. An upper, third level, or intermediate wash arm (not shown) is also preferably provided elsewhere in the tub cavity.

Figure 2:
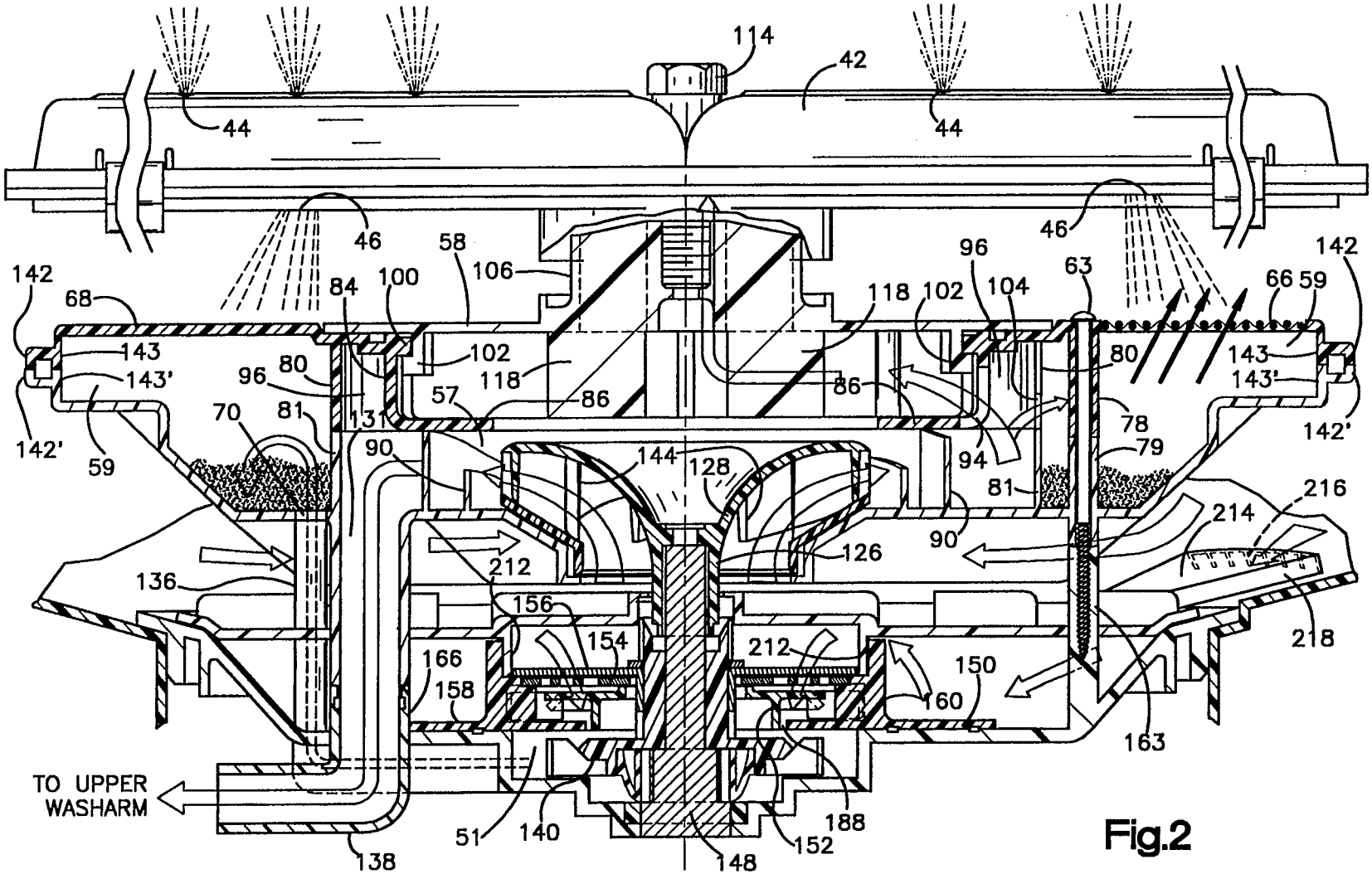
FIG. 2 is a front elevational view, partly in cross section, of a dishwasher pump and wash arm with the pump operated in a recirculation mode.
Figure 3:
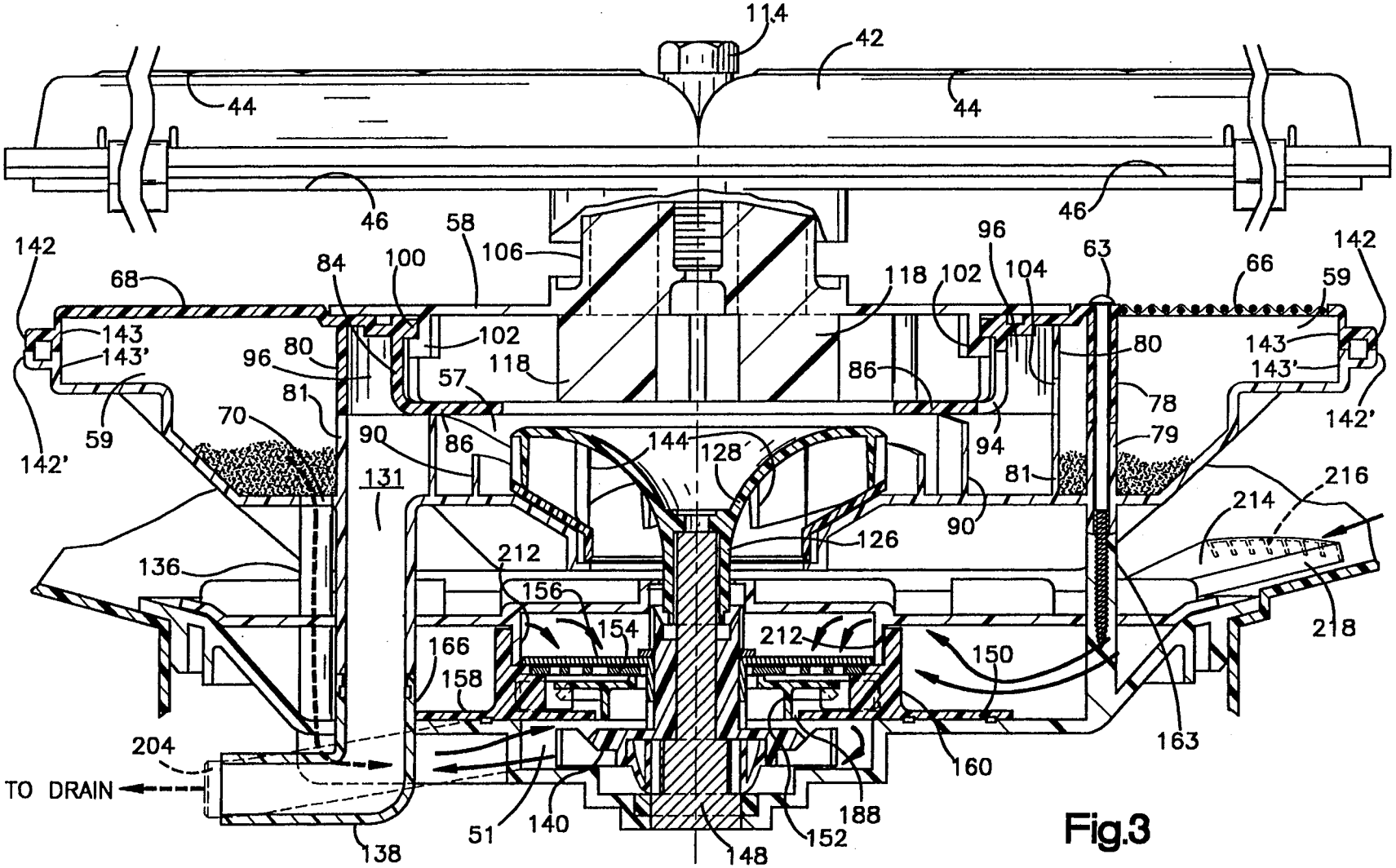
FIG. 3 is a front elevational view, partly in cross section, of the dishwasher pump and wash arm with the pump operated in a drain mode.

The wash arm 42 includes a number of upwardly and downwardly-directed openings or jets 44, 46 (FIGS. 2–3). The upwardly-directed openings 44 supply a cleansing spray of wash liquid to the items within the tub 34. The downwardly-directed openings 46 preferably provide a filter cleansing and wash arm propelling spray of wash liquid. For a more detailed description of the preferred construction and operation of the wash arm, reference should be made to commonly-owned U.S. patent application Ser. No. 08/056,996, which was filed on May 4, 1993, and is expressly incorporated herein in its entirety. Naturally, any type of wash arm can be used with the pump 32 of the present invention without departing from the scope thereof.

The pump 32 includes upper and lower assemblies 48 and 50. The lower assembly 50, which defines a drain impeller chamber 51, is shown generally in FIG. 7 and includes a separator plate 52, a macerator assembly 54, and a lower pump housing 56. The upper assembly 48, which defines a recirculation impeller chamber 57 and a filtration chamber 59, is shown generally in FIG. 4. The upper assembly includes a cap member 58, a filter housing top member 60, and a filter housing bottom member 62.

Figure 4:
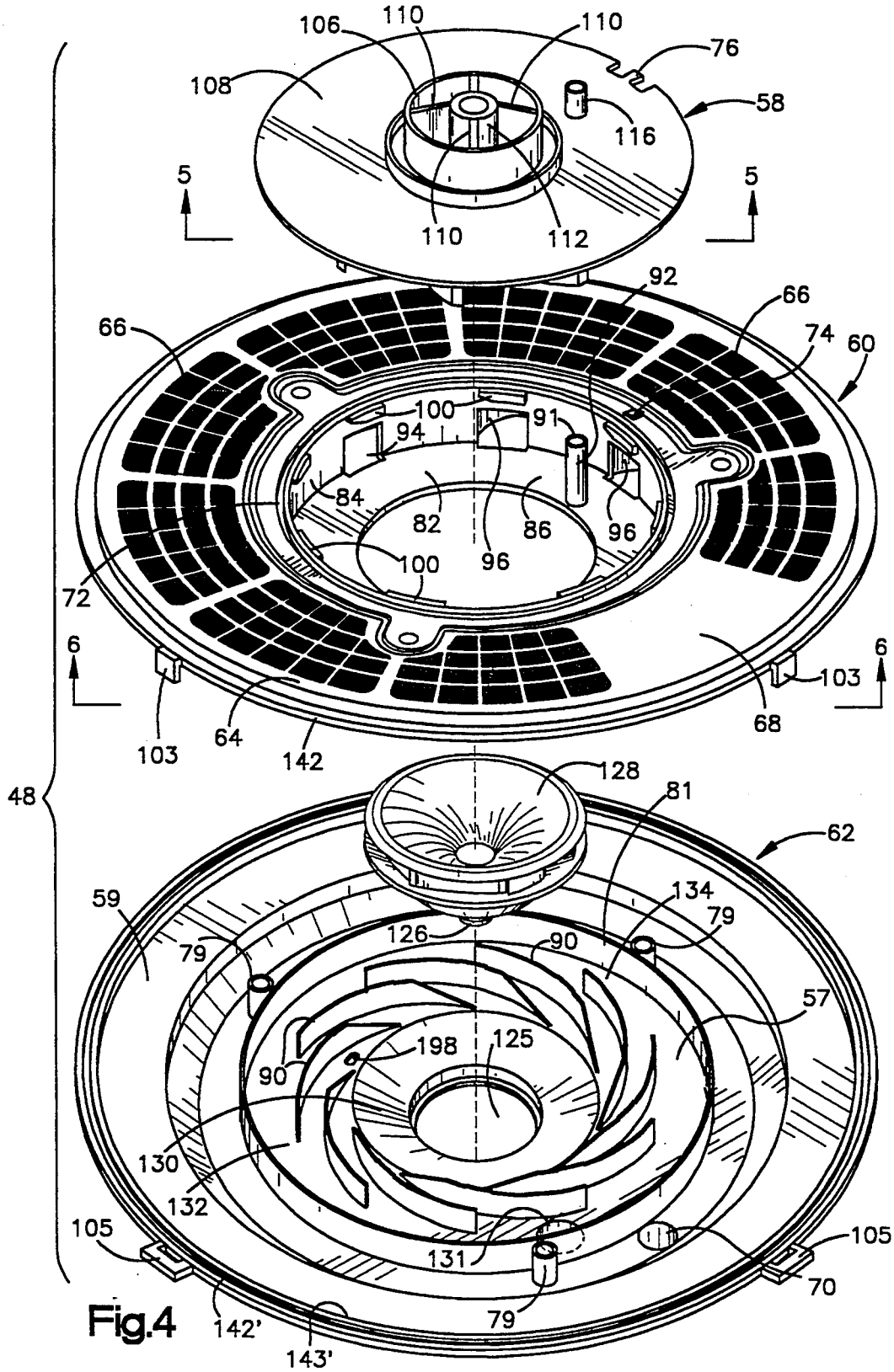
FIG. 4 is an exploded perspective view of the upper assembly of the dishwasher pump.
Figure 5:
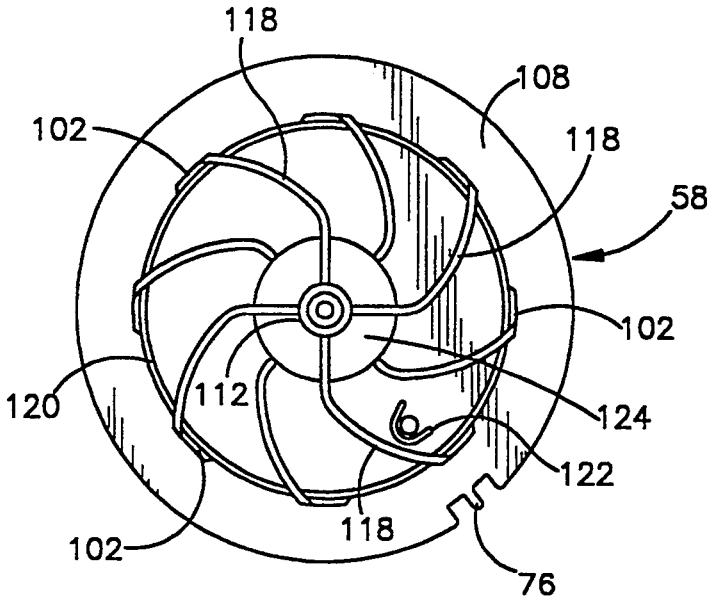
FIG. 5 is a bottom plan view of the cap member of the upper assembly.
Figure 6:
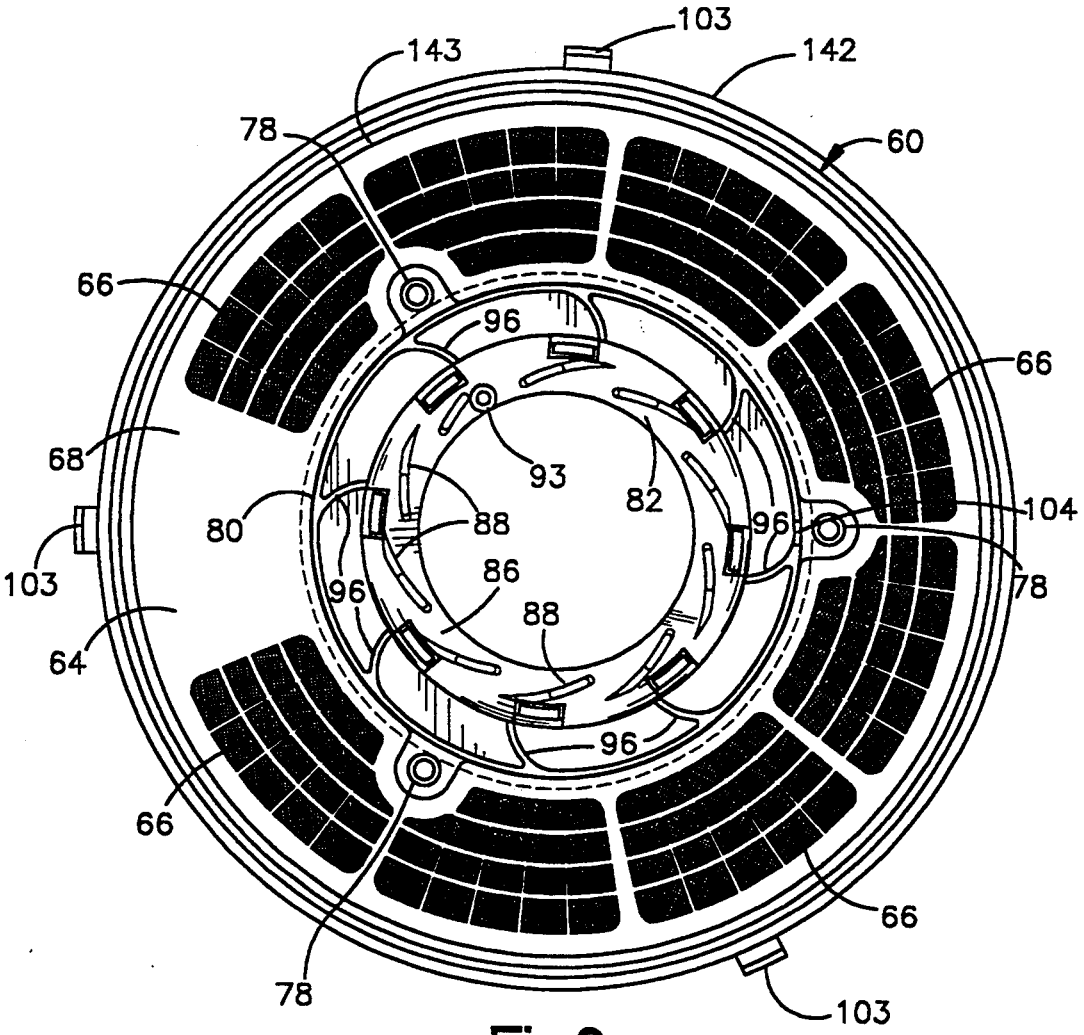
FIG. 6 is a bottom plan view of the top member of the upper assembly.

With reference to FIGS. 4 and 6, the top member 60 has an annular upper surface 64 including a series of fine mesh screen panels 66 and a solid deflector section 68. The deflector section 68 surmounts a filtration chamber inlet 70 provided by the bottom member 62, and is operable to divert wash liquid entering the filtration chamber 59, as will be described hereafter. The mesh screens 66 filter solid particles from wash liquid passing therethrough and cause the filtered particles to be retained within the filtration chamber 59. The mesh screens 66 are preferably integrally molded in the upper surface 64, but may also be constituted by individual mesh portions or a perforated plastic top. Preferably, the screens 66 are back-flushed by wash liquid expelled from the downwardly-directed wash arm jets 46, as illustrated in FIG. 2.

An 0-ring (not shown) is received within an outer annular groove 72 surrounding the opening defined by the annular upper surface 64 and seals the union of the cap member 58 and top member 60 (FIG. 4). Outwardly adjacent the 0-ring receiving groove 72 the annular surface 64 provides an upwardly ramping latch member 74 which is adapted to engage a projecting tab 76 of the cap member 58 and thereby releasably secure the cap member 58 to the top member 60, as will be described more fully hereafter.

As shown best in FIGS. 2, 3, 4, and 6, a series of hollow mounting posts 78, a cylindrical dividing wall 80, and a bowl-shaped member 82 extend downwardly from the annular upper surface 64. The mounting posts 78 are outwardly adjacent the dividing wall 80 and align with like hollow posts 79 provided by the bottom member 62. Posts 79 in turn engage upwardly projecting posts 163 on the lower pump housing 56 to allow screws 63 to secure the upper and lower assemblies 48 and 50 together as a unit.

The bowl-shaped member 82 includes a cylindrical vertical wall 84 extending downwardly from the circular inner edge of the annular upper surface 64 and a ring-shaped horizontal wall 86 extending radially inwardly from a terminal end of the cylindrical vertical wall 84 (FIGS. 2, 3, and 4). The ring-shaped wall 86 provides a series of curved, downwardly-extending projections 88 which, as will be described more fully hereafter, merge with curved fluid-directing vanes 90 provided by the bottom member 62 during assembly, and thereby aid in securing the top and bottom members 60, 62 together.

A stand pipe 92 projects upwardly and downwardly from the ring-shaped horizontal wall 86. The stand pipe 92 has an upper terminal end 91 which is generally co-planar with the annular upper surface 64 and is adapted to connect with the cap member 58. A lower terminal end 93 of the stand pipe 92 is angle-cut and issues into the recirculation impeller chamber 57. The angle-cut allows the stand pipe 92 to introduce air into the recirculation impeller chamber 57 when the pump 32 is operated in the drain mode, while a small amount of wash liquid (i.e., between about one and two quarts per minute) is expelled through the stand pipe 92 when the pump 32 is operated in the recirculation mode.

The cylindrical vertical wall 84 of the bowl-shaped member 82 is discontinuous, being interrupted by a series of slotted openings 94. A series of downwardly-directed projecting arcuate directional vanes 96 extend between the cylindrical vertical wall 84 and the dividing wall 80 and are operable to direct wash liquid through the slotted openings 94 in the vertical wall 84.

A series of camming members 100 extend radially inward from an upper edge of the cylindrical wall 84. The camming members 100 overlie the slotted openings 94 and cooperate with lugs 102 provided by the cap member 58 to tightly secure the cap member 58 to the top member 60, as will be apparent from the following description.

The cylindrical dividing wall 80 provided by the top member includes a generally U-shaped notched opening 104 through which wash liquid flows from the recirculation impeller chamber 57 to the filtration chamber 59. The notched opening 104, which is provided adjacent one of the mounting posts 78, will become more circular due to the process of assembling the top and bottom members 60, 62. Particularly, the cylindrical dividing wall 80 of the top member 60 aligns and merges with a like dividing wall 81 provided by the bottom member 62 and thereby separates the recirculation impeller chamber 57 from the filtration chamber 59.

The annular upper surface 64 provides a series of peripheral mounting lugs 103 which are received by projecting members 105 that extend radially from the periphery of the bottom member 62. Preferably, three mating lugs 103 and members 105 are provided at non-equidistant locations around the periphery of the top and bottom members 60, 62, thereby insuring that the top and bottom members are correctly aligned during assembly.

As shown best in FIGS. 2–5, the cap member 58 includes an upstanding cylindrical hub 106 and a generally planar main body 108. The hub 106 is adapted to rotatably receive the wash arm 42 and to that end includes a series of radially inwardly extending arms 110. The arms 110 support an internally threaded cylinder 112 to which is threadably secured a wash arm retaining screw 114.

The main body 108 is generally circular, having a central opening therein and the projecting tab 76 on an outer edge thereof. As mentioned hereinbefore, the projecting tab 76 is provided to snap-fit over the upwardly ramping latch 74 and thereby releasably prevent rotation of the cap relative to the top member 60. The main body 108 also has a stand pipe extension 116 projecting upwardly therefrom, while a plurality of arcuate guide vanes 118, a short cylindrical wall 120, and a stop member 122 projecting downwardly therefrom.

The stop member 122 is generally U-shaped, and surrounds the upper terminal end 91 of the stand pipe 92 when the cap member 58 is placed on the top member 60 to insure alignment between the stand pipe 92 and the stand pipe extension 116. The arcuate guide vanes 118 merge at a radially outer end with the short cylindrical wall 120. The opposite ends of the guide vanes 118 alternately underlie the arms 110 or terminate adjacent the central opening, as illustrated.

The guide vanes 118 direct wash liquid to the wash arm 42 via a central distribution channel 124 defined by the upstanding hub 106. The lugs 102 provided by the short cylindrical wall 120 extend radially outwardly therefrom and engage the camming members 100 of the top member 60 to secure the cap member 58 thereto, as illustrated.

As shown best in FIG. 4, the bottom member 62 is concave when viewed from above, and provides a central opening 125 through which a stem 126 of a recirculation impeller 128 downwardly projects. Surrounding the central opening is a ramping annular surface 130 and a ring-shaped surface 132. The short cylindrical dividing wall 81 and the curved fluid-directing vanes 90 project upwardly from the ring-shaped surface 132. As stated previously, the cylindrical dividing wall 81 of the bottom member 62 aligns and merges with the dividing wall 80 of the top member 60 during assembly and, with the exception of the hole or opening 104 formed therein, fluidly isolates the recirculation impeller chamber 57 from the filtration chamber 59. The mounting posts 79 project upwardly and downwardly from the ring-shaped surface 132. An auxiliary wash arm inlet 131 and the filtration chamber inlet 70 are on opposite sides of the dividing wall 81, as illustrated.

The fluid-directing vanes 90 merge with the projections 88 provided by the top member 60 during assembly to provide an interconnecting and integral vane structure between the top and bottom members 60, 62. With particular reference to FIG. 4, a ring-shaped open space 134 is provided between the fluid-directing vanes 90 and the dividing wall 81 of the bottom member 62. The arcuate directional vanes 96 overlie the ring-shaped open space 134.

During the recirculation mode, wash liquid is guided by the fluid-directing vanes 90 into this ring-shaped space 134 and follows a circular flow path. Some of an upper portion of this circularly-flowing wash liquid flows through the hole 104 and into the filtration chamber 59 while the remainder contacts the arcuate directional vanes 96 and changes direction, flowing radially inwardly, contacting or engaging the guide vanes 118 provided by the cap member 58. The guide vanes 118 thereafter force the wash liquid to flow toward the central distribution channel 124 in the hub 106, upwardly through the hub, and into the wash arm 42. A lower portion of the circularly flowing wash liquid enters the auxiliary wash arm inlet 131 and flows to the auxiliary wash arm (not shown).

As illustrated best in FIGS. 2, 3, and 4, the filtration chamber inlet 70 and the auxiliary wash arm inlet 131 align with a filtration chamber duct 136 and an auxiliary wash arm duct 138, respectively, which project downwardly from the bottom member 62. As will be discussed more fully hereafter, the recirculation impeller 128 supplies wash liquid to the auxiliary wash arm (not shown) via the auxiliary wash arm duct 138 while wash liquid is provided to the filtration chamber 59 by a drain impeller 140 (FIGS. 7, 12, and 13) via the filtration chamber duct 136. Naturally, the auxiliary wash arm duct 138 will be removed or plugged should an auxiliary wash arm not be provided.

The top and bottom members 60, 62 are preferably formed of a filled polypropylene and include aligning and engaging peripheral annular ribs 142, 143 and 142′, 143′, respectively, which cooperate to sealingly attach the periphery of the members 60, 62 and thereby create the main housing portion of the upper assembly 48. Preferably, the engaging surfaces of the top and bottom members 60, 62 are heated to a temperature above the melting point of the material by correspondingly shaped heating plates and thereafter pressed together to merge or bond the top and bottom members. More specifically, the inner rib 143, the projections 88, and the dividing wall 80 of the top member 60 are heated by a matingly-shaped heating plate (not shown) while the inner rib 143′, the fluid directing vanes 90, and the dividing wall 81 of the bottom member 62 are likewise heated by a matingly shaped heating plate (not shown). Once heated, the lugs 103 and the members 105 are aligned and the top and bottom members 60, 62 are thereafter pressed together to merge or unite the inner ribs 143 and 143′ the fluid-directing vanes 90 with the projections 88, and the dividing walls 80 and 81. The heating and pressing operation reduces the height of each of the mating members by about 0.030 inches. The outer ribs 142 and 142' serve as stop means to limit compression of the heated members. Naturally, the heating and pressing process can be replaced by other suitable attachment means or deleted for one or more of the aforementioned members without departing from the present invention.

The recirculation impeller 128 is rotatably mounted within the recirculating impeller chamber 57 which is defined by the merged dividing walls 80 and 81, top member 60, cap member 58, and bottom member 62. The recirculation impeller 128 includes a housing having a series of curved and upwardly and outwardly ramping vanes 144. The vanes 144 are relatively wide at their inner terminal ends, and progressively narrow toward their outer terminal ends.

The recirculation impeller 128 also includes the hollow shaft or stem 126 which extends downwardly, and preferably includes an inner bore with opposed planar sides to facilitate mounting and bi-directional rotation of the recirculation impeller 128 on a matingly-shaped shaft 148 provided by the motor (not shown). A fastener can extend through the top surface of the impeller 128 to secure the impeller to the motor shaft 148. The bottom of the impeller housing is open to allow wash liquid to be drawn into the housing by action of the rotating vanes 144. The wash liquid is centrifugally propelled by the impeller vanes 144 toward the curved fluid-directing vanes 90 provided by the bottom member 62.

With reference to FIGS. 7–15, the lower assembly 50 of the pump 32 is illustrated. The lower assembly includes, as stated hereinbefore, the drain impeller 140, the separator plate 52, the macerator assembly 54, and the lower pump housing 56. The macerator assembly 54 is designed to rest upon the lower pump housing 56 and includes a body member 150, a shroud 152, a perforated grate 154, the drain impeller 140, and a macerator blade 156.

Figure 7:
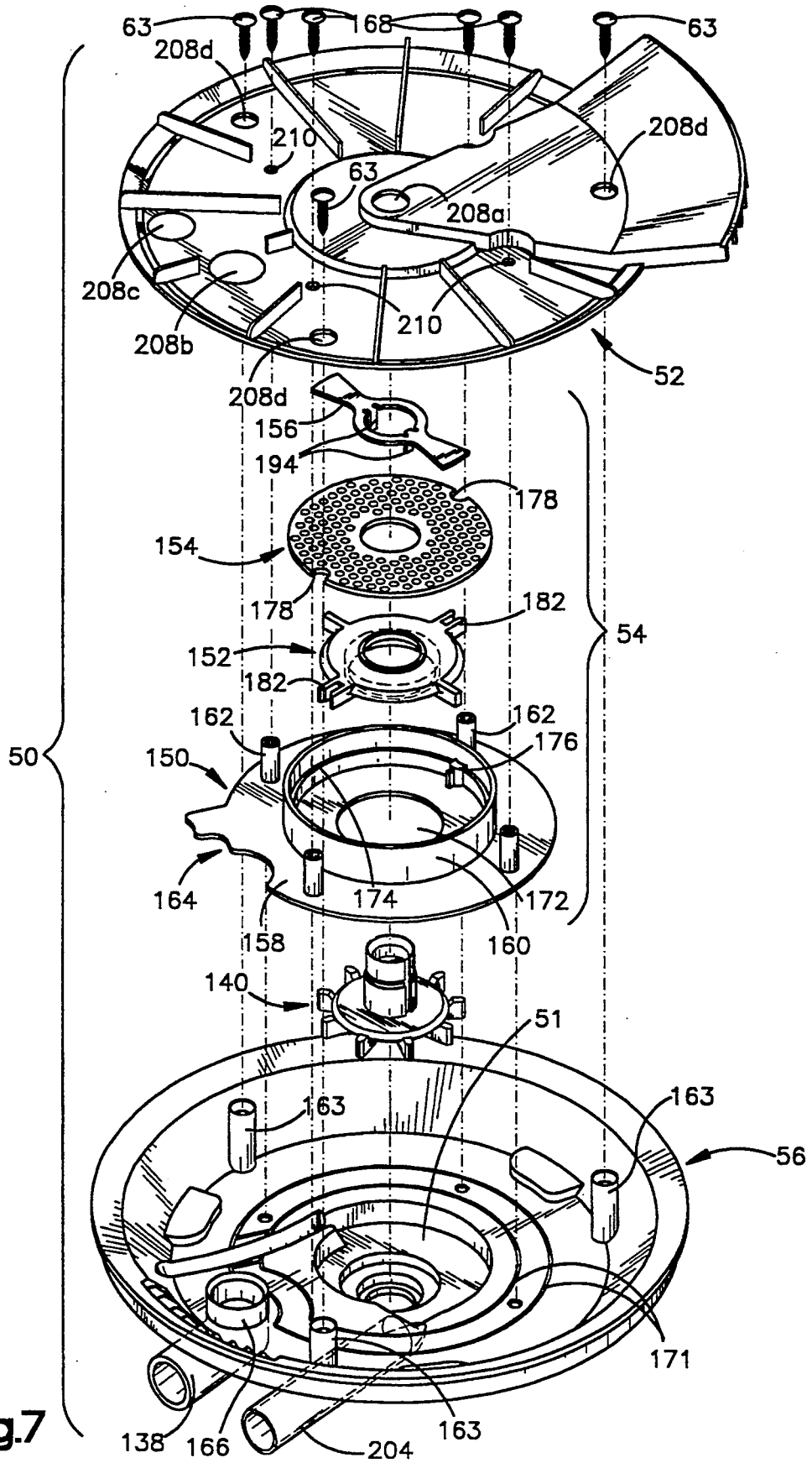
FIG. 7 is an exploded perspective view of the lower assembly.
Figure 10:
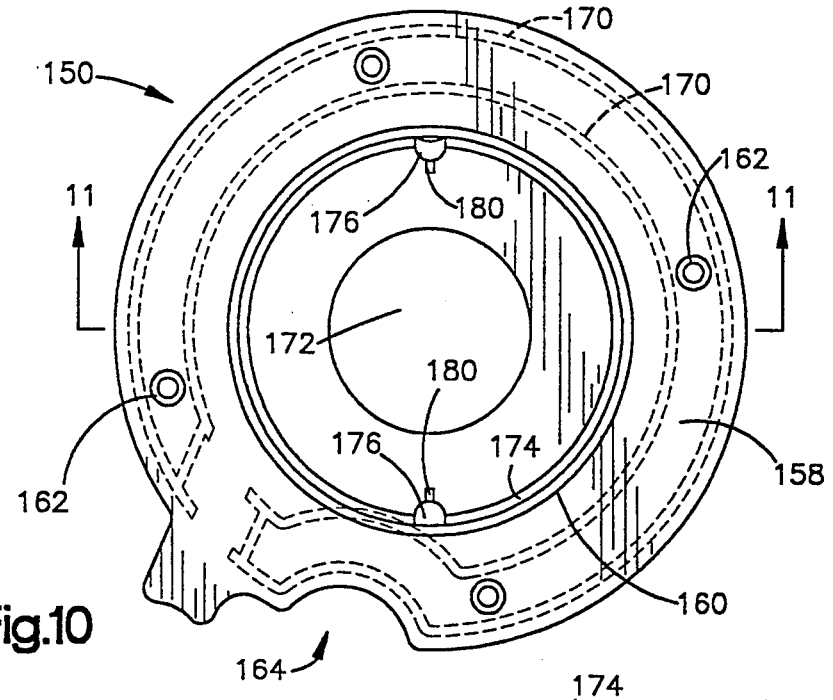
FIG. 10 is a top plan view of the main body member of a macerator assembly in the lower assembly.
Figure 11:
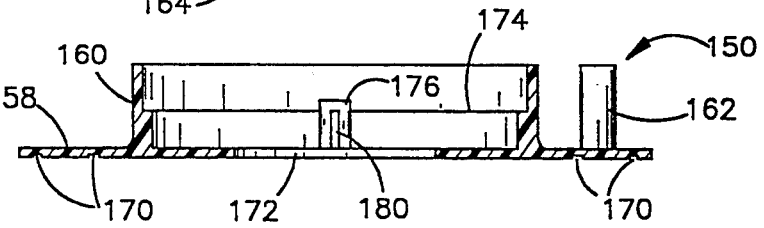
FIG. 11 is an elevational view, in cross-section, of the main body member, as viewed along line 11—11 in FIG. 10.

With reference to FIGS. 10 and 11, the body member 150 of the macerator assembly 54 is shown to have a planar mounting portion 158 and an upstanding flange 160. The mounting portion 158 includes a series of upwardly-directed hollow mounting posts 162 and a notched edge 164. The notched edge 164 is shaped to receive a cylindrical connection tube 166 projecting upwardly from the lower pump housing 56 and a slanted terminal end (not shown) of the filtration chamber duct 136. The cylindrical connection tube 166 connects to the auxiliary wash arm duct 138. The mounting posts 162 allow threaded fasteners 168 to secure the separator plate 52, macerator body member 150, and lower pump housing 56 together (FIG. 7).

With reference to FIG. 10, a lower or bottom surface of the body member 150 is shown to include a pair of concentric periphery-tracing grooves 170 which receive similarly-shaped ribs 171 (FIG. 7) provided by the lower pump housing. The grooves 170 and ribs 171 cooperate to define a labyrinth-type seal between the body member 150 and the lower pump housing 56. The body member 150 has a central opening 172 through which the drain impeller 140 extends, as illustrated in FIG. 7.

An inside surface of the upstanding flange 160 includes a circular lip 174 and a pair of semicircular posts 176. The lip 174 is designed to vertically support the grate 154 while the semi-circular posts 176 extend through like-shaped notches 178 in the grate and thereby rotationally position and retain the grate 154 relative to the body member 150. Inwardly extending from the posts 176 are mounting ribs 180.

Figure 14:
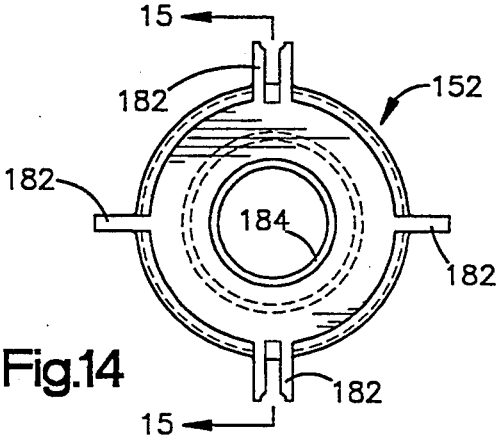
FIG. 14 is a top plan view of a shroud of the macerator assembly.
Figure 15:
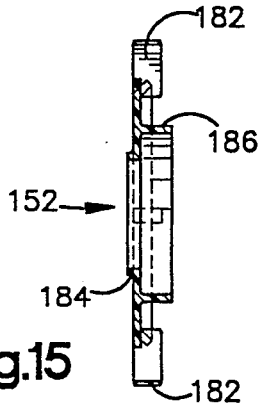
FIG. 15 is an elevational view, in cross-section, of the shroud as viewed along line 15—15 of FIG. 14.
Figure 16:
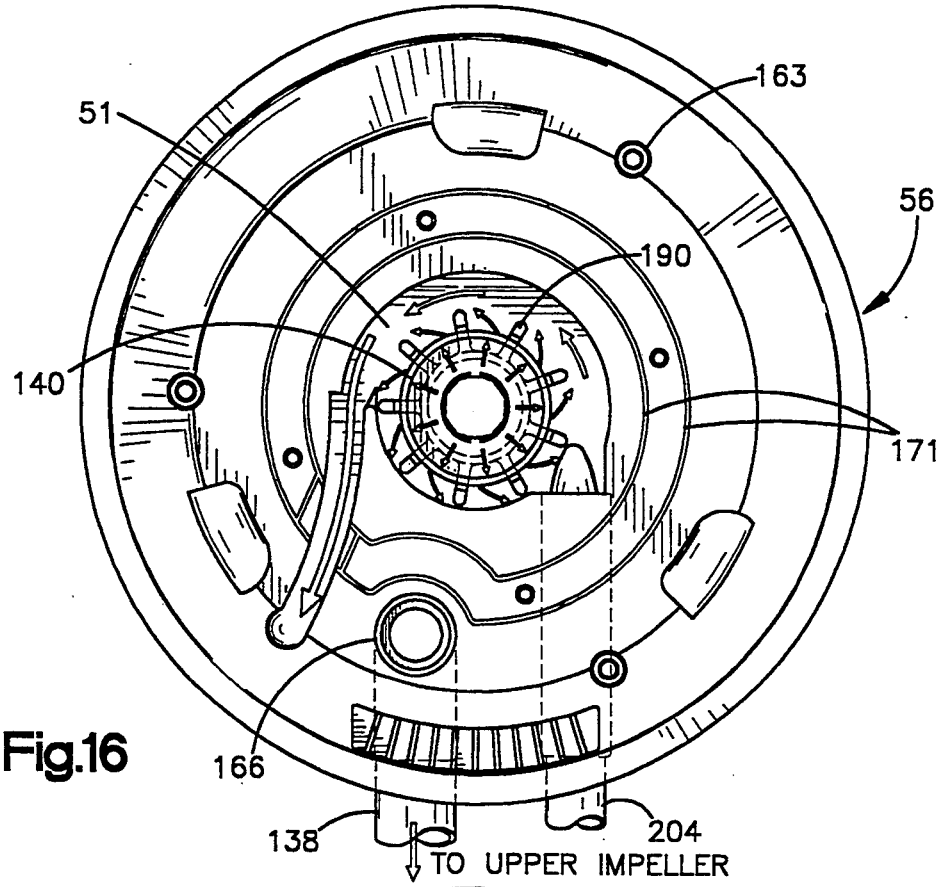
FIG. 16 is a top plan view of a portion the lower assembly showing wash liquid flow during the recirculation mode.
Figure 17:
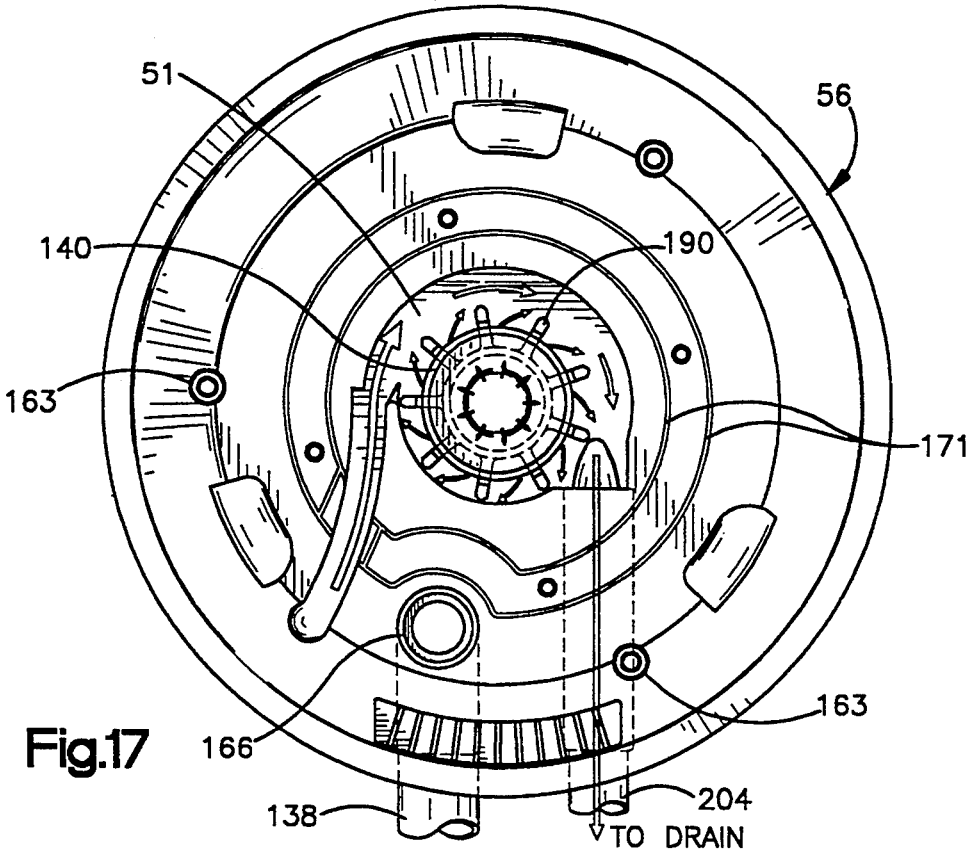
FIG. 17 is a top plan view of a portion of the lower assembly showing wash liquid flow during the drain mode.

The shroud 152, as illustrated in FIGS. 14 and 15, is generally circular, having four positioning arms 182 extending outwardly therefrom, and a circular upstanding rim 184 which surrounds an opening therein. Two of the arms 182 are slotted and slidably receive the mounting ribs 180 to position the shroud 152 relative to the body member 150. When the macerator assembly 150 is assembled, the rim 184 is generally co-planar with the circular lip 174 provided by the flange 160, and cooperates therewith to vertically support the perforated grate 154.

The underside of the shroud 152 provides a downwardly extending circular or cylindrical wall 186 which extends into the central hole in the body member 150. The cylindrical wall 186 is concentric with the central hole, and defines a passage through which the drain impeller 140 extends. A terminal edge of the wall 186 is generally co-planar with the lower surface of the body member 150. An annular space 188 between the cylindrical wall 186 and the inner circular edge of the body member 150 defines a wash liquid flow path between the macerator blade 156 and the drain impeller 140 (FIGS. 2 and 3).

The shroud 152 is surrounded by the upstanding flange 160 and lies between the body member 150 and the grate 154. The shroud restricts the flow of wash liquid through the grate 154 and thereby insures that items passing through the grate are first chopped or ground by the macerator blade 156. The shroud 152 also serves as a backstop for the grate 154, preventing a long thin item, such as a spaghetti noodle, from quickly passing through the grate 154 without being acted upon by the macerator blade 156. Moreover, the narrow flow path allowed by the shroud 152 slows the flow of solids and wash liquid past the macerator blade 156 and thereby gives the blade the opportunity to operate on the solids within the wash liquid. The downwardly-extending cylindrical wall 186 of the shroud 152 guides wash liquid toward the blades 190 of the drain impeller 140. The wash liquid is delivered at an outer portion of the drain impeller 140 (i.e., at the blades 190) to facilitate pumping thereby.

The macerator blade 156 is bow-tie shaped and is preferably formed, as is the grate 154, of a hardened stainless steel. The macerator blade 156 has an axially-aligned opening through which a drain impeller shaft 192 extends. A pair of projecting tabs 194 provided by the macerator blade 156 slidably fit into mating grooves 195 in the drain impeller shaft 192 to rotatably link the macerator blade 156 to the drain impeller 140. A spring clamp (not shown) fits into an annular groove in the drain impeller shaft 192 above the macerator blade 156 to maintain the blade on the shaft.

Figure 12:
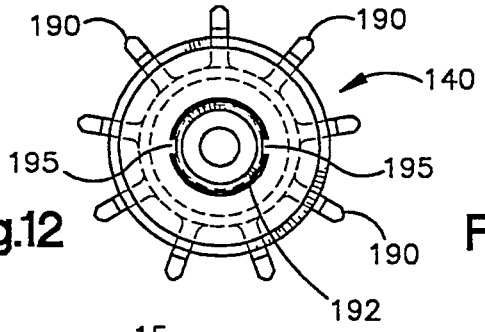
FIG. 12 is a top plan view of the drain impeller.
Figure 13:
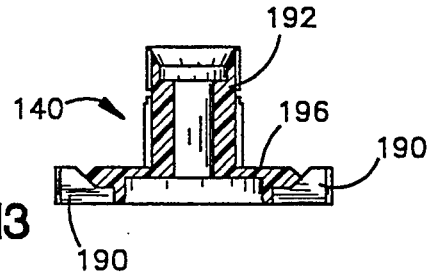
FIG. 13 is a front elevational view, in cross section, of the drain impeller shown in FIG. 12.

As shown in FIGS. 12 and 13 the drain impeller 140 provides, in addition to the series of radially outwardly projecting blades 190, an annular body portion 196 from which the drain impeller shaft 192 projects. The body portion 196 defines a recess into which is secured a connecting portion (not shown). The connecting portion helps to sealably attach the motor drive shaft 148 to the drain impeller shaft 192 and seals an opening in the lower pump housing 56 through which the motor drive shaft 148 projects.

The drain impeller shaft 192 has a longitudinal bore with a pair of opposed flat sides which matingly align with the motor drive shaft 148 to mount and rotatably link the drive shaft 148 to the drain impeller shaft 192. The drive shaft 148 projects upwardly out of the drain impeller shaft 192, extending toward and being attached to the recirculation impeller 128, as discussed hereinbefore.

Figure 9:
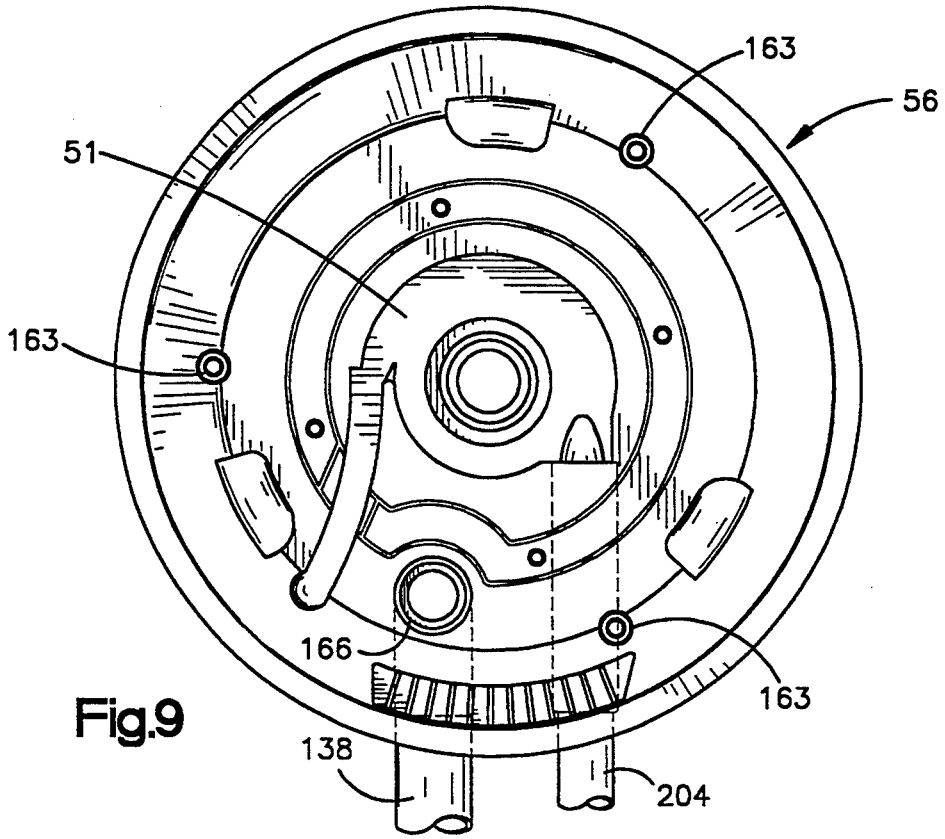
FIG. 9 is a top plan view of the lower pump housing of the lower assembly.

As illustrated best in FIG. 9, the lower pump housing 56 defines the drain impeller chamber 51 which is designed to receive the drain impeller 140 and, depending upon the direction of drain impeller 140 rotation, direct wash liquid either to the filtration chamber 59 or to drain (not shown). The auxiliary wash arm tube 138 and a drain tube 204 are integrally formed in the housing and are connected to the auxiliary wash arm and drain (not shown), respectively, by associated conduits (not shown). The drain conduit preferably includes a check valve (not shown) to prevent water from re-entering the drain impeller chamber 51 from the drain line when the pump 32 is operated in the recirculation mode.

A series of mounting posts 163 extend upwardly from the lower pump housing 56 and align with the downwardly extending mounting posts 79 provided by the upper assembly. The lower pump housing 56 also provides a set of threaded holes which allow the macerator assembly 54 and the separator plate 52 to be secured thereto with conventional fasteners.

Figure 8:
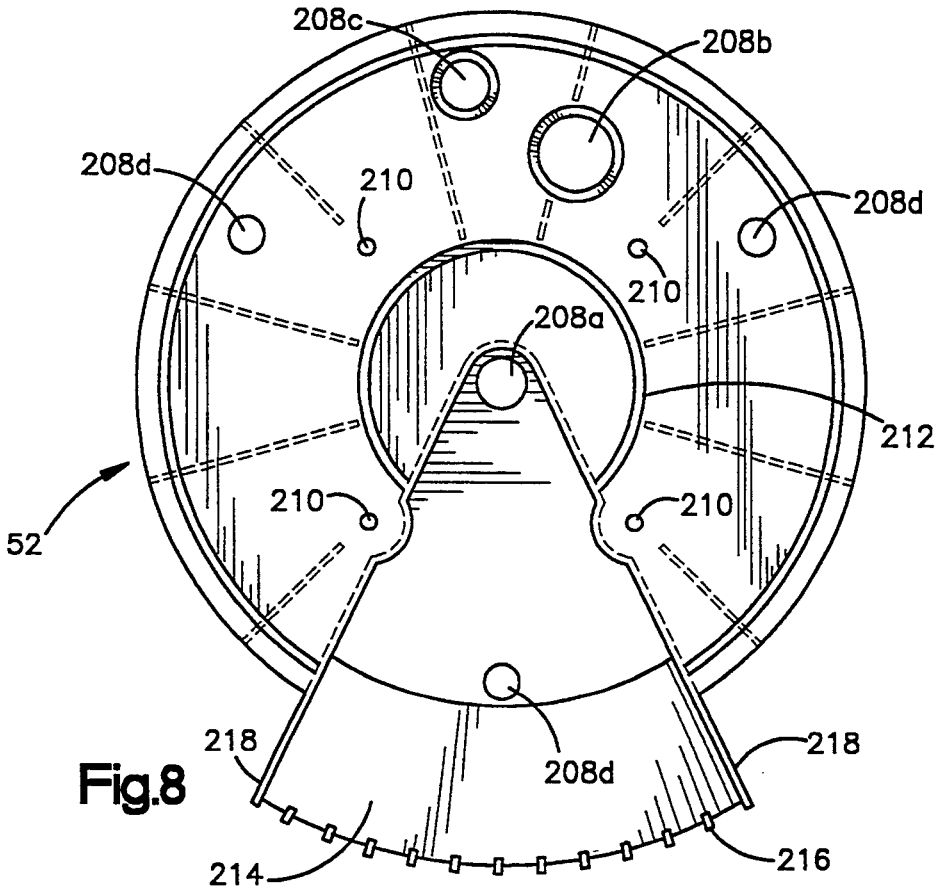
FIG. 8 is a bottom plan view of the separator plate of the lower assembly.

Turning to FIGS. 7 and 8, the separator plate 52 is shown to have a series of holes 208*a*, 208*b*, 208*c*, 208*d* formed therein through which respectively project the motor drive shaft 148, the auxiliary wash arm duct 138, the filtration chamber duct 136, and the lower pump housing mounting posts 163. A set of holes 210 are also provided in alignment with the mounting posts 162 provided by the macerator assembly body member 150, allowing conventional fasteners to attach the separator plate 52 and macerator assembly 54 to the lower pump housing 56, as stated hereinbefore.

The lower or bottom surface of the separator plate 52 includes a downwardly-extending C-shaped flange 212 and a wedge-shaped member 214 which includes finger members 216 at a terminal end thereof and a pair of depending side walls 218. The finger members 216 and side walls 218 extend downwardly and preferably abut with or engage the dishwasher tub 34. The finger members 216 serve as a coarse filter to prevent large items such as silverware from entering the drain impeller chamber 51.

The wedge-shaped member 214 is upwardly spaced from the remainder of the separator plate 52 and defines a wedge-shaped recess that is directed toward the opening in the C-shaped flange 212. When the separator plate 52 is attached to the lower pump housing 56, wash liquid flows through the coarse filter defined by the finger members 216 and into a space or trap defined by the upstanding flange 160, the C-shaped flange 212, the separator plate 52, and the lower pump housing 56. The C-shaped flange 212 nests or fits within the upstanding flange 160 and rests upon the perforated grate 178, thereby preventing wash liquid from entering the area of the macerator blade except at the open side in the "C". The cooperation of the flanges 160 and 212 insure that a quantity of liquid will be maintained within the trap, giving relatively heavy or dense material within the wash liquid an opportunity to settle. In the preferred illustrated embodiment, the open section of the C-shaped flange 212 faces the inlet. Naturally, this could be altered to have the open section of the C-shaped flange 212 face away from the inlet.

The operation of the pump 32 will be hereafter described with reference to the foregoing description and FIGS. 2, 3, and 16–19.

When the pump 32 is operated in the recirculation mode, wash liquid is taken from the sump 40 and pumped by the recirculation and drain impellers 128, 140. The recirculation impeller inlet is vertically spaced above the drain impeller inlet, allowing the more soil-laden portion of the wash water in the sump 40 to be pumped by the drain impeller directly to the filtration chamber 59, as will be discussed more fully hereafter.

Figure 18:
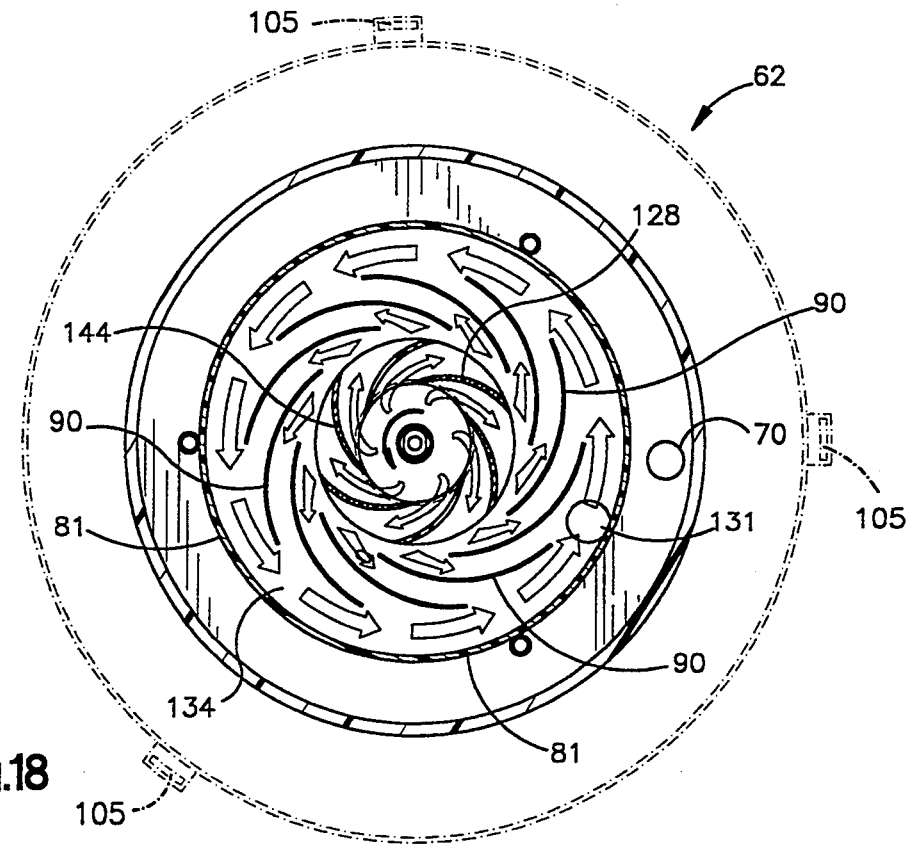
FIG. 18 is a top plan view of a portion of the upper assembly showing wash liquid flow during the recirculation mode.
Figure 19:
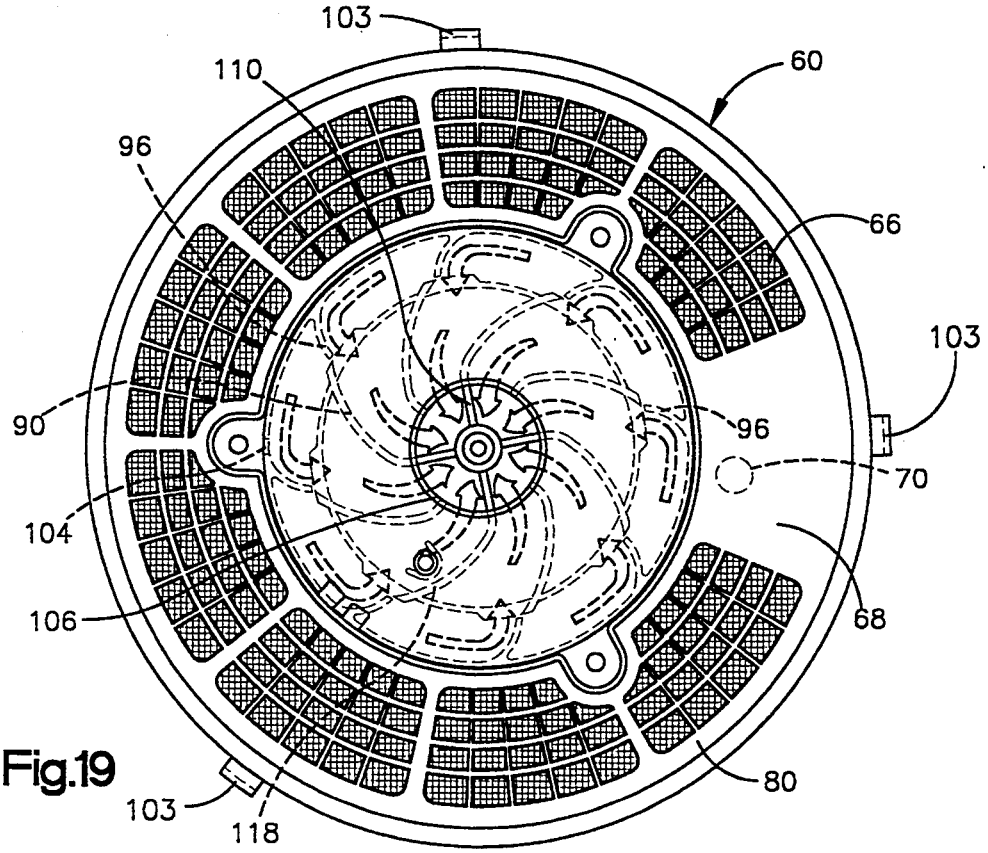
FIG. 19 is a top plan view of a portion of the upper assembly showing wash liquid flow during the recirculation mode.

Wash liquid enters the recirculation impeller 128 at the lower end thereof, and is forced to flow upwardly and outwardly by the ramping vanes 144 until contacting the fluid-directing vanes 90. The fluid-directing vanes 90 straighten out the stream of water and, in cooperation with the dividing wall 81, force the liquid to flow in a circular path in the ring-shaped space 134 (FIG. 18). A lower portion of the circularly flowing wash liquid enters the auxiliary wash arm inlet 131 and flows to the auxiliary wash arm (not shown). Preferably, the recirculation impeller pumps between about 192 to 200 liters (50 to 52 gallons) of wash liquid per minute when operated in the wash or recirculation mode.

An upper portion of the circularly flowing liquid is divided between the filtration chamber 59 and the wash arm 42. A small volume of wash liquid, about 23 liters (6 gallons) per minute, flows through the small hole 104 in the merged dividing walls 80, 81 and enters the filtration chamber, supplementing the flow of wash liquid from the drain impeller 140. The wash liquid flowing through the hole 104 strikes one of the posts 78 adjacent thereto, and is thereafter dispersed within the filtration chamber 59. The majority of the circularly-flowing wash liquid contacts the arcuate directional vanes 96 and changes direction, flowing radially inwardly through the holes 94 and into engagement with the guide vanes 118 provided by the cap member 58. The guide vanes 118 thereafter force the wash liquid to flow toward the central distribution channel 124 in the hub 106 and thereafter upwardly through the hub and into the wash arm 42. The wash liquid exits the wash arm via upwardly directed jets 44 which supply wash liquid to dishes being cleaned, and via downwardly directed jets 46 which supply a wash arm propelling and filter rinsing stream of water which impinges upon the mesh screen filter panels 66 and back-flushes or rinses soil therefrom.

The fluid directing vanes 90, dividing walls 80 and 81, arcuate directional vanes 96 and guide vanes 118 cooperate to define a fluid path for pumped wash liquid which allows the recirculation impeller 128 to pump a high volume of wash liquid. The wash liquid from the recirculation impeller 128 is guided by the fluid directing vanes 90 enters the relatively larger ring-shaped space 134 in which the wash liquid is at a relatively lower pressure than at the recirculation impeller 128. The wash liquid in the ring-shaped space 134 is guided by the directional vanes 96 and the guide vanes 118 into a relatively smaller space at a relatively higher pressure to the wash arm 42. It is believed that providing the ring-shaped space 134 intermediate the wash arm 42 and the recirculation impeller 128 reduces the fluid back-pressure experienced by the recirculation impeller 128 and allows the impeller to pump a relatively higher volume of wash liquid than would otherwise be possible.

Wash liquid enters the drain impeller chamber 51 via the downwardly extending finger members 216 provided by the separator plate 52. The wash liquid flows into the trap defined by the upstanding flange 160, the C-shaped flange 212, the separator plate 52, and the lower pump housing 56. Wash liquid within the trap flows over the upstanding flange 160 at the open space in the C-shaped flange 212, and is operated on by the rotating macerator blade 156 as it passes through the perforated grate 154.

Once through the grate 154, the wash liquid flows around the shroud 152, and is engaged by the blades 190 of the drain impeller 140. The drain impeller 140 pumps the wash liquid upwardly through filtration chamber duct 132 and into the filtration chamber 59. As the wash liquid enters the filtration chamber, it engages the deflector section 68 immediately above the filtration chamber inlet 70, and then disperses throughout the filtration chamber 59. Preferably, wash liquid is supplied to the filtration chamber 59 by the drain impeller at a rate of about 23 liters (6 gallons) per minute when the pump is operated in the recirculation mode. Thus the total flow into the filtration chamber 59 in the recirculation mode is about 46 liters (12 gallons) per minute.

Soil carried by the wash liquid settles to the bottom of the filtration chamber 59 and the wash liquid flows through the filter screens 66 provided on the top surface 64 of the upper assembly 48. Additional soil is filtered by the filter screens 66, and is rinsed from the filter screens by the spray from the downwardly-directed wash arm jets 46.

When the pump 32 is reversed to operate in the drain mode, air is introduced into the recirculation impeller chamber 57 by the stand pipe 92, causing the recirculation impeller 128 to cavitate and be rendered generally inoperable. A small hole 198 in the lower member 62 helps the recirculation impeller chamber 57 drain. However, due to rotational inertia and the limited ability of the recirculation impeller 128 to pump water for a short time, the wash arm 42 continues to rotate slowly and the water contained therein continues to rinse the filter screens 66.

Reversing the pump 32 to operate in the drain mode also causes the drain impeller 128 to reverse direction and pump wash liquid to drain. Preferably, the drain impeller 128 pumps wash liquid to drain at a rate of about 15 liters (4 gallons) per minute when operated in the drain mode. The wash liquid from the sump 40 continues to flow past the macerator blade 156, allowing the macerator to chop up any pieces of soil entrained in the sump wash water.

The wash liquid contained in the filtration chamber 59, together with the filtered and settled soil, flows down the filtration chamber duct 136 and into the drain impeller chamber 51. The wash liquid from the filtration chamber combines with the wash liquid from the sump which has passed by the macerator blade 156 and perforated grate 154 and, together with the associated soil, is pumped to drain by the drain impeller 140 via drain tube 204.

While the preferred embodiment of the present invention is shown and described herein, it is to be understood that the same is not so limited but shall cover and include any and all modifications thereof which fall within the purview of the invention.

What is claimed is:

1. A dishwasher assembly comprising a drain impeller, a pump housing member, and a macerator assembly, said pump housing member cooperating with the macerator assembly to define a drain impeller chamber, said macerator assembly including a main body portion, a shroud, and a perforated grate, said main body portion including an upstanding cylindrical wall in which the grate, the shroud and a macerator blade are mounted, said cylindrical wall isolating the macerator blade from a bottom surface of the pump housing member and preventing settled material within the pump housing from engaging the macerator blade, wherein said grate lies between the macerator blade and the shroud, said shroud, grate, and blade being surrounded by said wall.

2. A dishwasher assembly as in claim 1, wherein an inner surface of the cylindrical wall includes an annular lip which vertically supports the grate.

3. A dishwasher assembly as in claim 2, wherein the inner surface of the cylindrical wall includes an inwardly projecting rib which locates and retains the shroud relative to the wall.

4. A dishwasher assembly as in claim 1, further comprising a separator plate, said separator plate providing a downwardly extending flange which nests with said cylindrical wall.

5. A dishwasher assembly as in claim 1, further comprising a recirculation impeller housed within a recirculation impeller chamber defined by a cap member, a top member and a bottom member, said recirculation impeller being operable to pump wash liquid to a rotatably mounted wash arm and to a filtration chamber.

6. A dishwasher assembly as in claim 5, Wherein the filtration chamber is defined by the top and bottom members and receives wash liquid pumped by the recirculation and drain impellers, the top member including a filtration screen to filter soil from wash liquid leaving the filtration chamber.

7. A dishwasher assembly as in claim 5, wherein the recirculation impeller is surrounded by a series of curved fluid-directing vanes and a cylindrical dividing wall which cooperate to direct wash liquid pumped by the recirculation impeller to flow radially outwardly and then in a circular path.

8. A dishwasher assembly as in claim 7, wherein a first portion of the circularly-flowing liquid engages a series of arcuate directional vanes and flows radially inwardly toward a series of guide vanes, the guide vanes causing the pumped wash liquid to converge and flow upwardly into a rotatably mounted wash arm.

9. A dishwasher assembly as in claim 8, wherein a second portion of the circularly flowing wash liquid passes through a hole in the cylindrical dividing wall and into the filtration chamber.

10. A dishwasher as in claim 9, wherein a third portion of the circularly flowing wash liquid is directed to an upper wash arm.

11. A dishwasher assembly comprising a drain impeller, a pump housing member, a separator plate, and a macerator assembly, said pump housing member cooperating with the macerator assembly to define a drain impeller chamber, said macerator assembly including a main body portion, a macerator blade, and a perforated grate, said main body portion including an upstanding cylindrical wall which surrounds said grate and isolates the macerator blade from a bottom surface of the pump housing member to prevent settled material within the pump housing from engaging the macerator blade, wherein an inner surface of said cylindrical wall includes an annular lip which vertically supports said grate, said separator plate including a downwardly extending flange which nests with said cylindrical wall.

12. A dishwasher assembly as in claim 11, further comprising a recirculation impeller housed within a recirculation impeller chamber defined by a cap member, a top member and a bottom member, said recirculation impeller being adapted to pump wash liquid to a rotatably mounted wash arm and to a filtration chamber.

13. A dishwasher assembly as in claim 12, wherein the filtration chamber is defined by the top and bottom members and receives wash liquid pumped by the recirculation and drain impellers, the top member including a filtration screen to filter soil from wash liquid leaving the filtration chamber.

14. A dishwasher assembly as in claim 12, wherein the recirculation impeller is surrounded by a series of curved fluid-directing vanes and a cylindrical dividing wall which cooperate to direct wash liquid pumped by the recirculation impeller to flow radially outwardly and then in a circular path.

15. A dishwasher assembly as in claim 14, wherein a first portion of the circularly-flowing liquid engages a series of arcuate directional vanes and flows radially inwardly toward a series of guide vanes, the guide vanes causing the pumped wash liquid to converge and flow upwardly into a rotatably mounted wash arm.

16. A dishwasher assembly as in claim 15, wherein a second portion of the circularly flowing wash liquid passes through a hole in the cylindrical dividing wall and into the filtration chamber.

17. A dishwasher assembly as in claim 16, wherein a third portion of the circularly flowing wash liquid is directed to an upper wash arm.

18. A dishwasher assembly as in claim 11, wherein said macerator assembly further comprises a shroud, said grate being located between said shroud and said macerator blade.

19. A dishwasher assembly as in claim 18, wherein the inner surface of said cylindrical wall includes an inwardly projecting rib which locates and retains the shroud relative to the cylindrical wall.

* * * * *